US008585057B2

(12) United States Patent
Wang

(10) Patent No.: US 8,585,057 B2
(45) Date of Patent: Nov. 19, 2013

(54) GAME MACHINE

(75) Inventor: Chih-Chieh Wang, Taichung (TW)

(73) Assignee: Youal-Jifh Enterprise Co., Ltd., Taichung (TW)

( * ) Notice: Subject to any disclaimer, the term of this patent is extended or adjusted under 35 U.S.C. 154(b) by 95 days.

(21) Appl. No.: 13/408,470

(22) Filed: Feb. 29, 2012

(65) Prior Publication Data

US 2013/0221619 A1 Aug. 29, 2013

(51) Int. Cl.
*A63F 9/00* (2006.01)

(52) U.S. Cl.
USPC ..... 273/459; 273/454; 273/460

(58) Field of Classification Search
USPC ..... 273/440, 445, 446, 454, 459, 460
See application file for complete search history.

(56) References Cited

U.S. PATENT DOCUMENTS

| | | | | |
|---|---|---|---|---|
| 7,600,760 | B2 * | 10/2009 | Matsuda et al. | 273/447 |
| 8,016,292 | B1 * | 9/2011 | Yang et al. | 273/451 |
| 8,079,597 | B1 * | 12/2011 | Wei | 273/451 |
| 8,167,311 | B1 * | 5/2012 | Wang | 273/451 |
| 8,448,948 | B1 * | 5/2013 | Shoemaker, Jr. | 273/447 |
| 2006/0175760 | A1 * | 8/2006 | Holsten et al. | 273/440 |
| 2013/0049300 | A1 * | 2/2013 | Yang et al. | 273/445 |

* cited by examiner

*Primary Examiner* — Raleigh W Chiu

(57) ABSTRACT

A game machine includes a frame and a control unit mounted on the frame. A rack assembly and a moving unit are respectively positioned in the frame, wherein the rack assembly is provided for containing prizes and a hammering device is mounted onto the moving unit. The moving unit and the hammering device are respectively electrically connected to the control unit. After inserting coin, the player can use the control unit to operate the moving unit for moving the hammering device to a purposed position. Finally, the player operates the hammering device to strike the rack assembly for forming vibration to move the selected prize and the prize is used as a reward after falling from the rack assembly.

12 Claims, 8 Drawing Sheets

GAME MACHINE

BACKGROUND OF THE INVENTION

1. Field of the Invention

The present invention relates to a game machine, and more particularly to a game machine that has a hammering device for forming vibration to move the prize in the game machine.

2. Description of Related Art

The most popular game machine is a claw machine that uses a overhead travelling crane and a catcher to catch a wanted prize that is disposed in the game machine, wherein the overhead travelling crane is used as an X-Y axis moving unit and the catcher is used as a Z axis moving unit. The catcher is opened to release the caught prize when aligning with the dispensing hole and the player can get the prize as a reward.

However, the above conventional game machine includes several latent disadvantages. The conventional game machine uses an electromagnetic valve as a brake source such that the catcher immediately releases the caught prize when a power failure is caused and the player operates in vain. Consequently, some unworthy game machine manager suddenly go and return over human visual frequency to get a lawless huge benefit. Secondly, the power of the electromagnetic valve is adjusted or the original electromagnetic valve is change to one having a lower power. As a result, the catcher can not provide an enough clamping power to catch the purposed prize. It is unfair to the players.

The present invention has arisen to mitigate and/or obviate the disadvantages of the conventional game machine.

SUMMARY OF THE INVENTION

The main objective of the present invention is to provide an improved game machine that has a hammering device for forming vibration to move the prize in the game machine.

To achieve the objective, the game machine in accordance with the present invention comprises a frame including a panel formed on a front side thereof, wherein the upper portion of the panel is transparent for user to easily operate the game machine. An opening is defined in a lower portion of the panel and a guide apparatus mounted in a lower portion of the frame for guiding a falling prize to the opening such that the player can easily take the falling prize. A control unit is mounted on the panel of the frame. A rack assembly is disposed in the frame. The rack assembly is divided multiple rooms and each room has a plate pivotally mounted therein for support the prize. Each plate has a front edge extending out of a front side of the rack assembly for being stricken. A moving unit is disposed in the frame and electrically connected to the control unit. A hammering device is mounted onto the moving unit and electrically connected to the control unit. The hammering device includes a shelf mounted on the moving unit, a drive device mounted on the shelf, a clutch mounted on the drive device, a sensor mounted on the shelf and a hammer connected to the clutch. The hammer is situated within a sensing area of the sensor when the clutch can be driven by the drive device and in a connecting condition. An angle of elevation of the hammer relative to the sea level is smaller than 90 degrees corresponding to a front side of the rack assembly when the clutch is in a connecting condition.

The hammer in accordance with the present invention is used to replace the electromagnetic valve of the convention game machine. Consequently, the unworthy managers can not get improper income by adjusting the electromagnetic valve. Accordingly, the players (consumers) can play the game machine under a fair condition.

Further benefits and advantages of the present invention will become apparent after a careful reading of the detailed description with appropriate reference to the accompanying drawings.

DETAILED DESCRIPTION OF THE INVENTION

Figure 1:
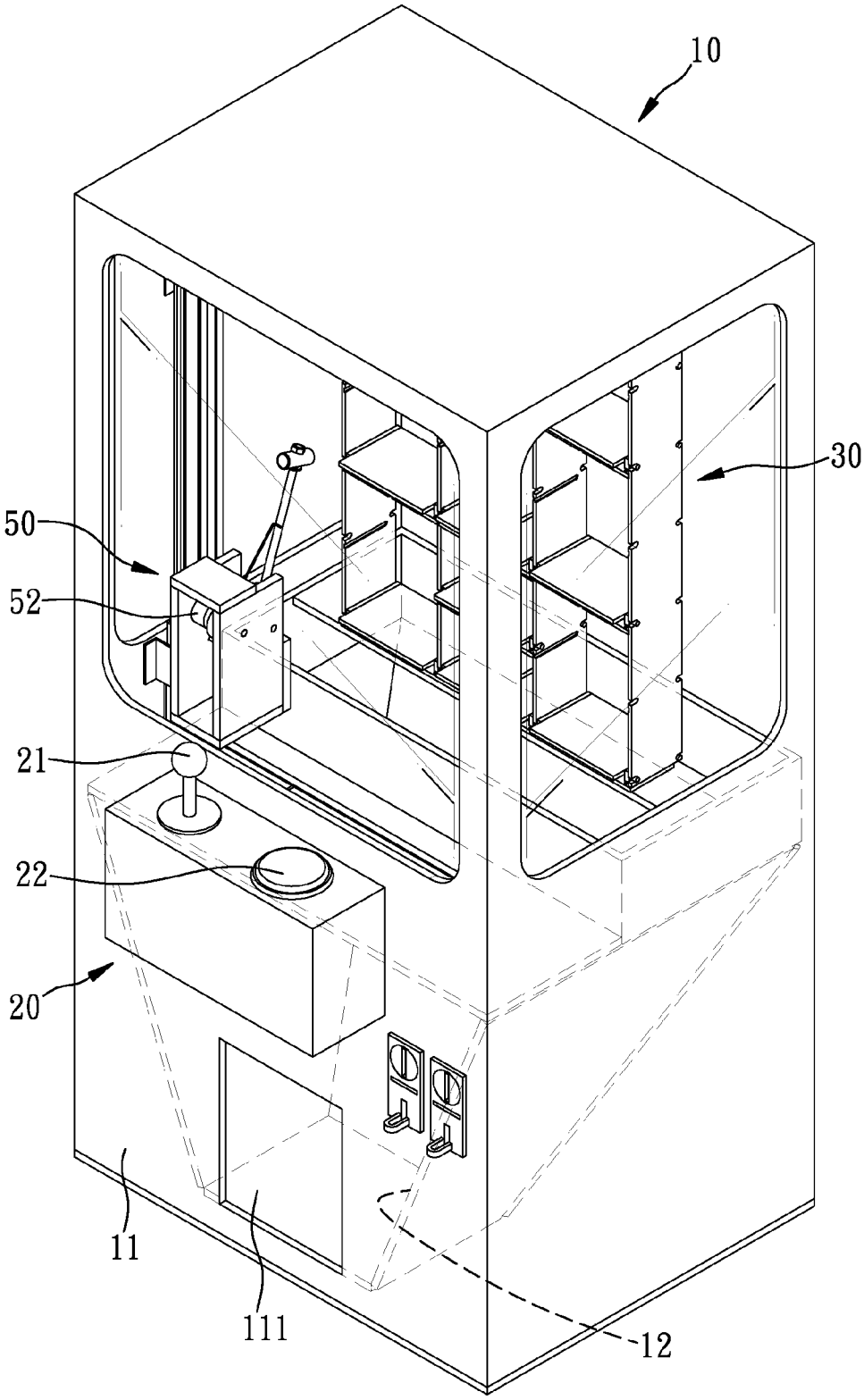
FIG. 1 is a perspective view of a game machine in accordance with the present invention.
Figure 2:
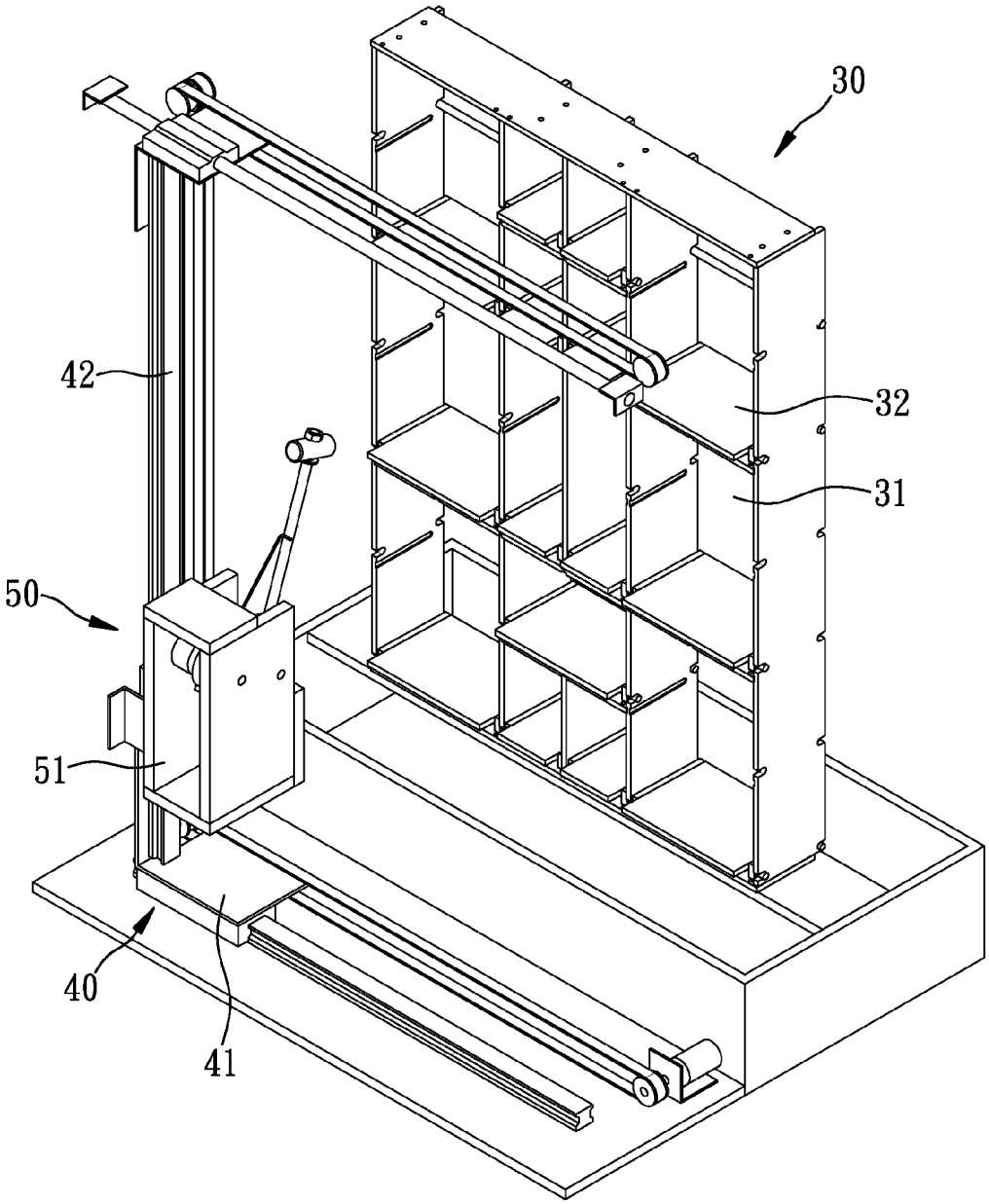
FIG. 2 is a partially perspective view of the game machine in FIG. 1.
Figure 3:
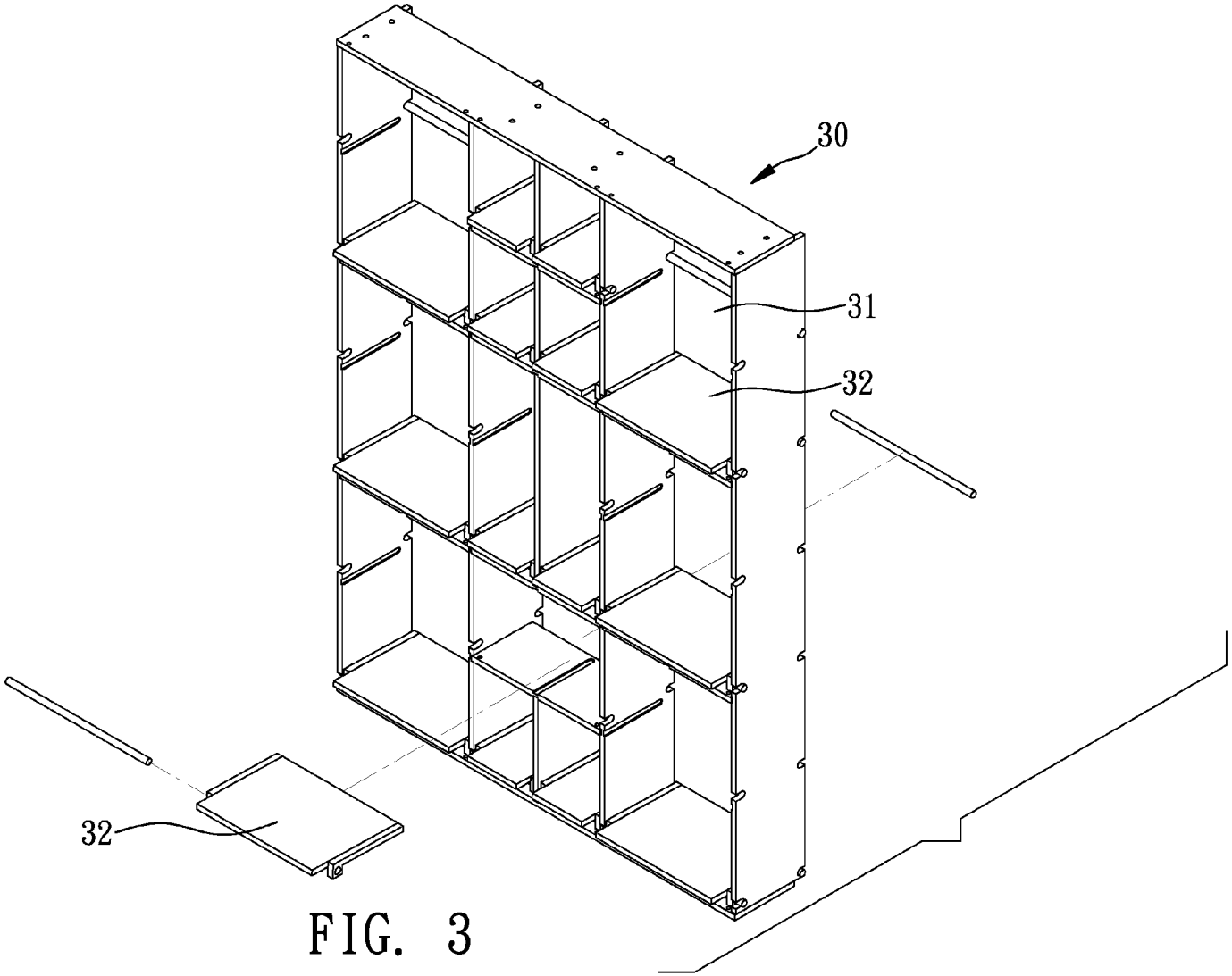
FIG. 3 is a perspective view of a rack assembly on the game machine in FIG. 1.

Referring to the drawings and initially to FIGS. 1-4, a game machine in accordance with the present invention comprises frame (10) and a control unit (20) mounted on the frame (10). A rack assembly (30) and a moving unit (40) are respectively positioned in the frame (10), wherein the rack assembly (30) is provided for containing prizes (A) and a hammering device (50) is mounted onto the moving unit (40). The moving unit (40) and the hammering device (50) are respectively electrically connected to the control unit (20). After inserting coin, the player can use the control unit (20) to operate the moving unit (40) for moving the hammering device (50) to a purposed position. Finally, the player operates the hammering device (50) to strike the rack assembly (30) for forming vibration to move the selected prize (A) and the prize is used as a reward after falling from the rack assembly (30).

The frame (10) includes a panel (11) formed on a front side thereof, wherein the upper portion of the panel is transparent for user to confirm the position of the hammering device (50) and guide the hammering device (50) to the position that corresponds to a purposed prize (A). An opening (111) is defined in a lower portion of the panel (11). A guide apparatus (12) is mounted in a lower portion of the frame (10) for guiding the falling prize (A) to the opening (111) such that the player can easily take the falling prize (A).

The control unit (20) includes a stick (21) and a button (22) respectively disposed thereon, wherein the stick (21) and the button are respectively provided to operate the moving unit (40) and the hammering device (50).

The rack assembly (30) is divided into series of rooms (31). Each room (31) has a plate (32) pivotally mounted therein for supporting a prize (A). Each plate (32) has a front edge extending out of a front side of the rack assembly (30).

The moving unit (40) includes an X-axis moving device (41) and a Y-axis moving device (42) mounted on the X-axis moving device (41) such that the moving route of the hammering device (50) forms a complete plane.

The hammering device (50) includes a shelf (51) mounted on the Y-axis moving device (42), a drive device (52) mounted on the shelf (51), a clutch (53) mounted on the drive device (52), a sensor (54) mounted on the shelf (51) and a hammer (55) connected to the clutch (53). The hammer (55) is situated within a sensing area of the sensor (54) when the clutch (53) is driven by the drive device (52) and in a connecting condition. At this moment, an angle of elevation of the hammer (55) relative to the sea level is smaller than 90 degrees corresponding to a front side of the rack assembly (30). The sensor (54) can prevent the hammer (55) from overly moved when being moved to its original position for next operation. Consequently, the hammer (55) automatically falls to strike the front edge of a corresponding one of the plates (32) for forming vibration due to the gravity thereof when the clutch (53) is driven by the drive device (52) and in a separate condition.

In the preferred embodiment of the present invention, the drive device (52) is a one-way motor. The clutch (53) includes a drive gear (531) securely sleeved on an axle (not shown) of the one-way motor and a driven gear (532) rotatably mounted onto the shelf (51). The drive gear (531) has a toothed section (533) peripherally formed thereon such that the clutch (53) is in a connecting condition when the driven gear (532) is engaged to the toothed section (533) of the drive gear (531). The hammer (55) includes a shaft (551) laterally mounted onto one side of the driven gear (532) and a counterweight (552) secured on a free end of the shaft (551) for promoting the momentum of the hammer (55) when falling.

Figure 4:
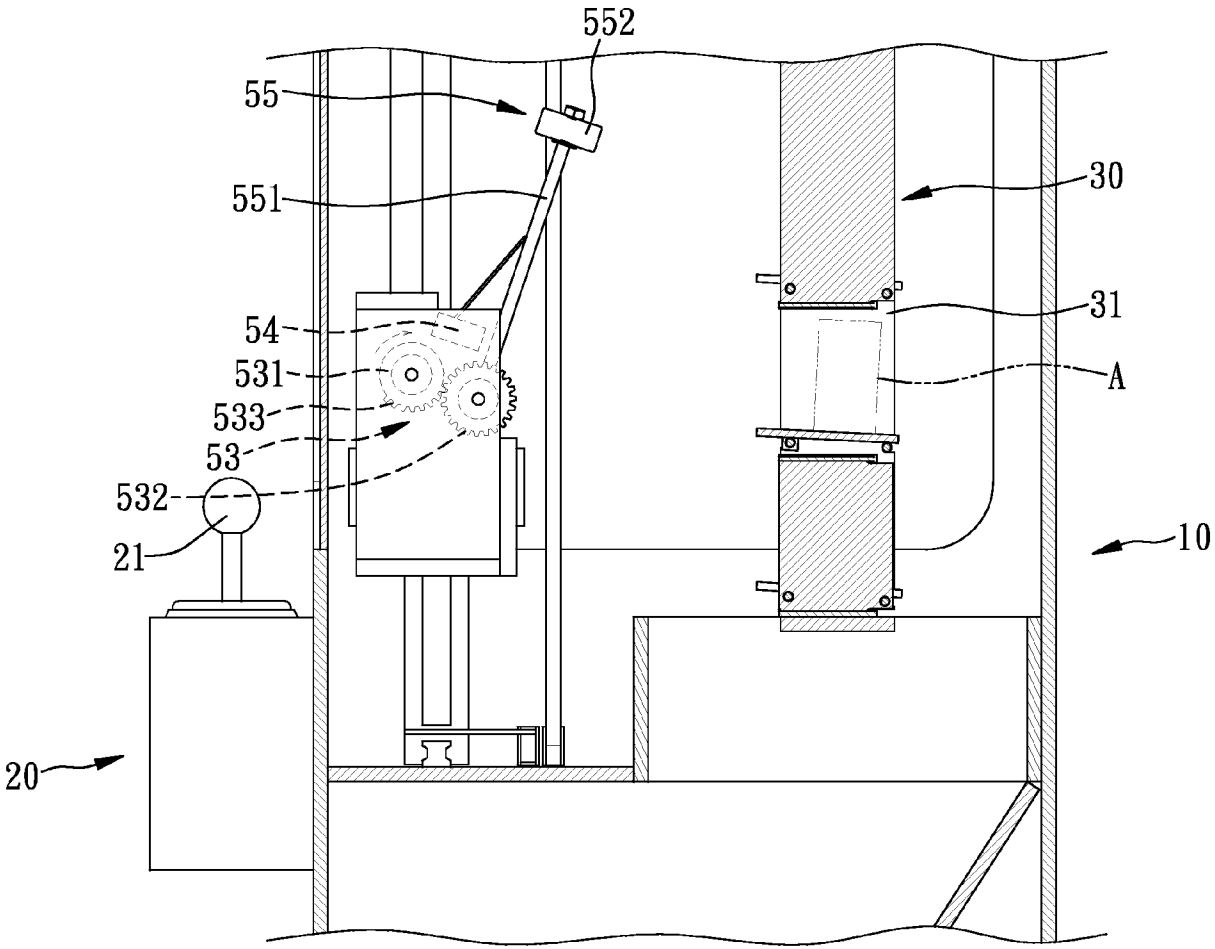
FIG. 4 is a partially side plan view of the game machine in FIG. 1 for laterally showing a harming device in accordance with present invention.
Figure 5:
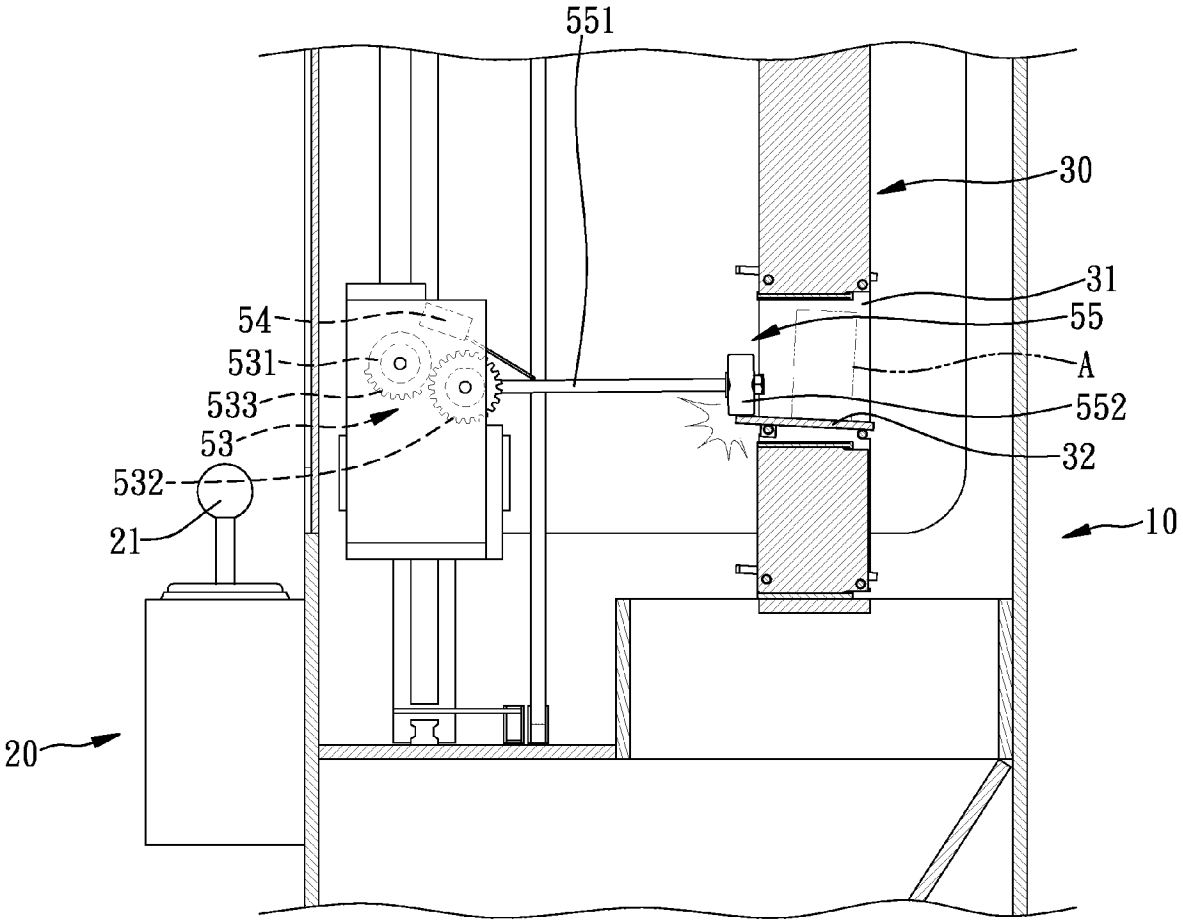
FIG. 5 is a first operational view of the game machine in accordance with the present invention.
Figure 6:
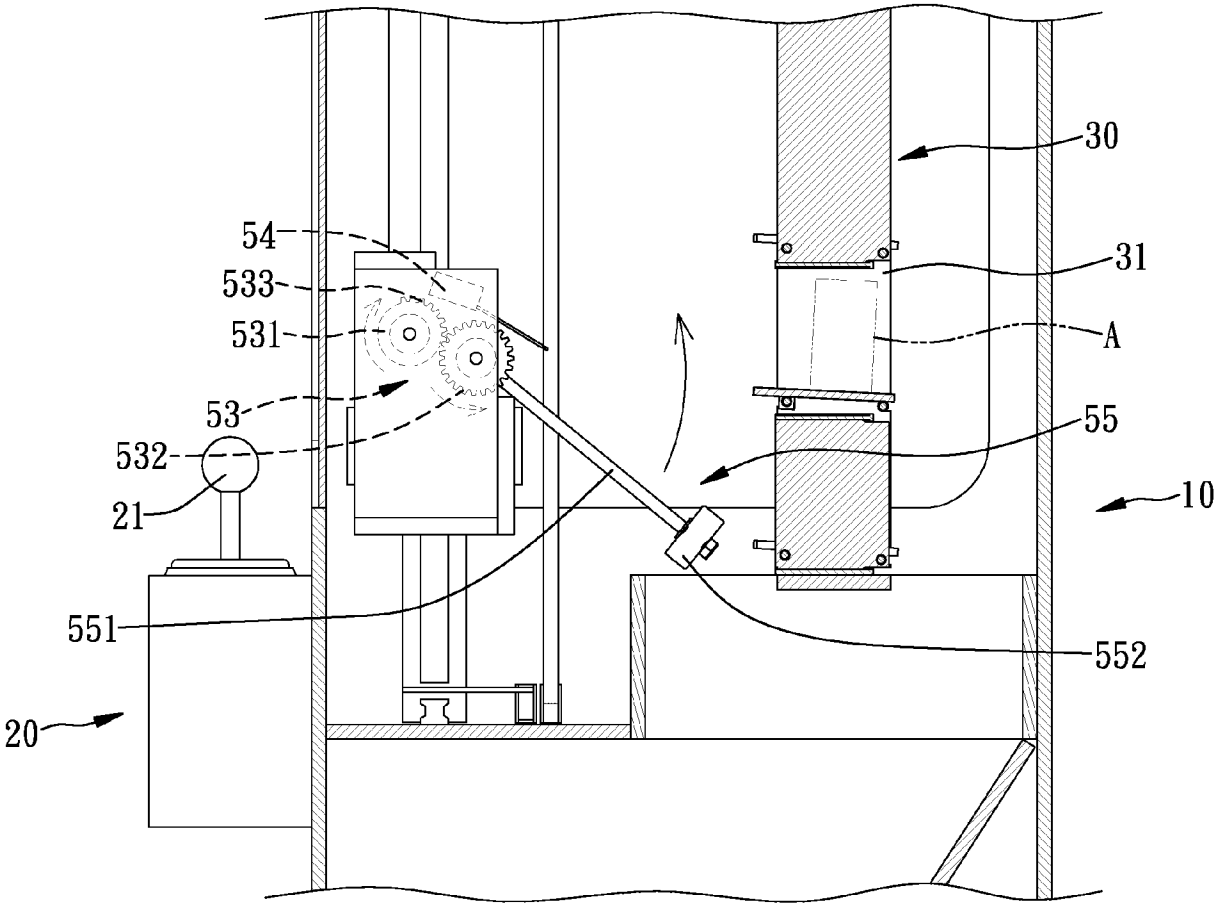
FIG. 6 is a second operational view of the game machine in accordance with the present invention.

With reference to FIGS. 1 to 6, after inserting coin, the player can use the stick (214) to control the X-axis moving device (41) and the Y-axis moving device (42) to move to the hammering device (50) to a place that corresponds the purposed prize (A). The button (22) is pressed to make the drive device (52) rotating the drive gear (531) clockwise, as shown in FIG. 4. The toothed section (533) of the drive gear (531) has one end engaged to the driven gear (532) before the drive gear (531) being operated such that the hammer (55) may be slightly lifted when the driven gear (532) starting being operated. The hammer (55) suddenly falls due to the gravity thereof and strike the front edge of the corresponding plate (32) and form vibration to move the purpose prize (A) when the toothed section (533) of the drive gear (531) is separated from the driven gear (532), and the driven gear (532) and the hammer (55) is in a free condition. The moved prize (A) is used as a reward when falling from the rack assembly (30) and moved to the opening (111) through the guiding apparatus (12). At the time, the drive device (52) continually rotates the drive gear (531). The hammer (55) is lifted when the toothed section (533) is engaged to the driven gear (532), again. The sensor (54) senses the hammer (55) and sends a signal to stop the drive device (52) and operation when the hammer (55) is moved to its original position. With reference to FIG. 6, the drive gear (531) can also lift the hammer (55) to its original position with the toothed section (533) when the hammer (55) does not strike the plate (32). In the preferred embodiment of the present invention, the sensor (54) is a limit switch and the drive device (52) is stopped when the hammer (55) abuts against the sensor (54).

As described above, the hammer (55) in accordance with the present invention is used to replace the electromagnetic valve of the convention game machine. Consequently, the unworthy managers can not get improper income by adjusting the electromagnetic valve. Accordingly, the players (consumers) can play the game machine under a fair condition.

Figure 7:
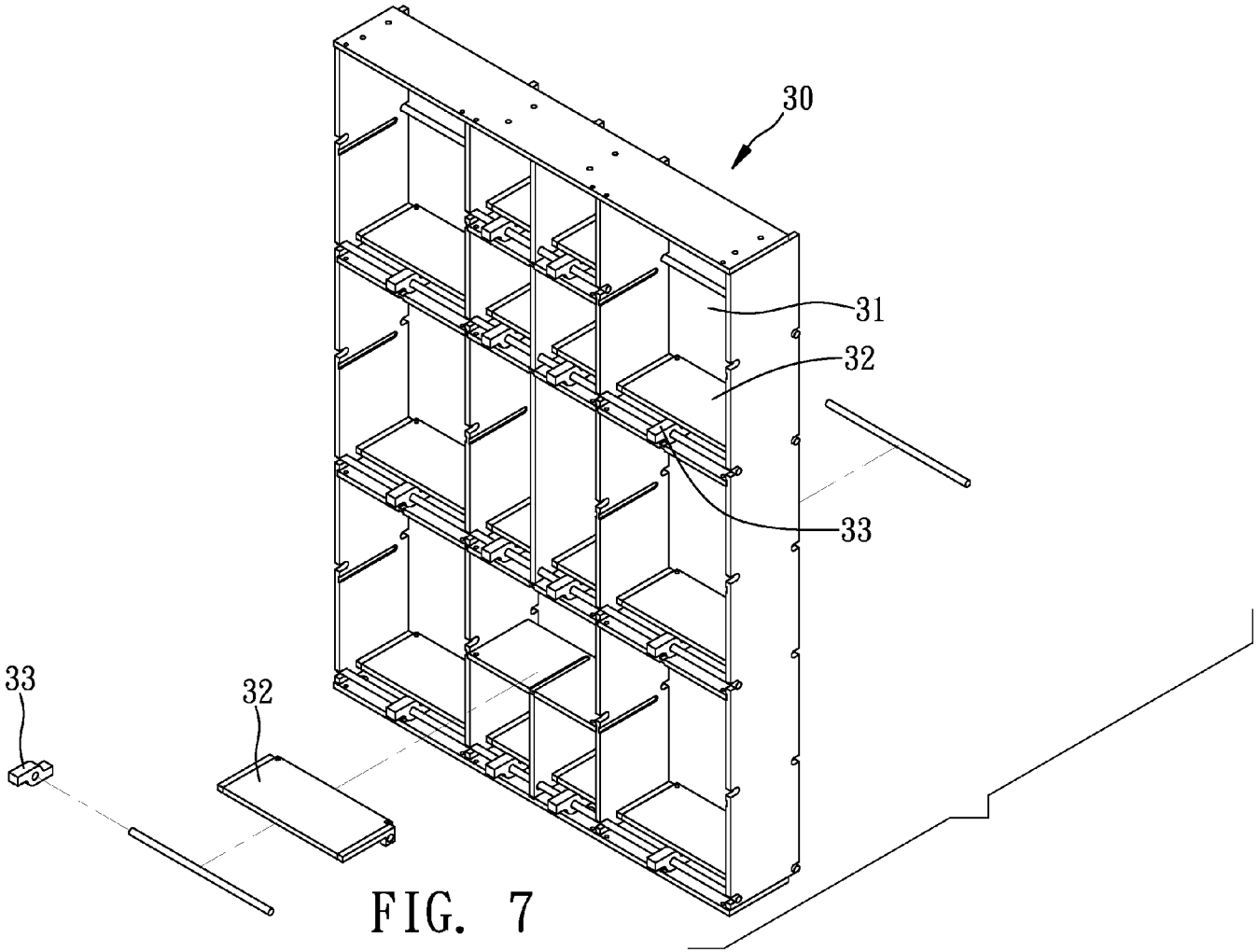
FIG. 7 is a perspective view of a second embodiment of the rack assembly in accordance with the present invention.
Figure 8:
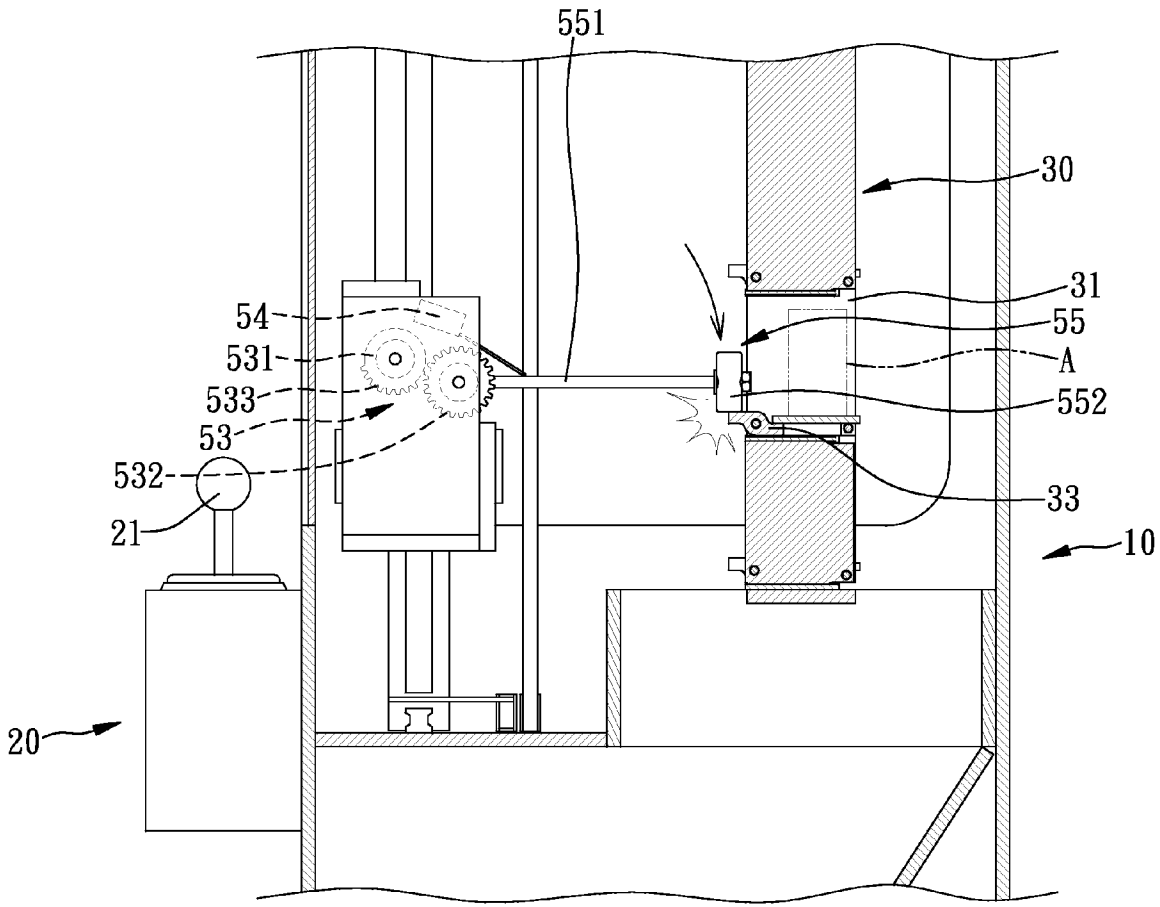
FIG. 8 is an operational view of the second embodiment of the game machine in accordance with the present invention.

For promoting the degree of difficulty of operating the present invention and enticing the managers to providing prize with high value, a second embodiment of the rack assembly (30) in accordance with the present invention is provided, as shown in FIGS. 7 and 8. In this embodiment, the rack assembly (30) further comprises multiple seesaws (33), wherein each seesaw (33) is pivotally mounted into a front portion of a corresponding of the rooms (31). The seesaw (33) is divided into a front section provided for hammer (55) to strike and a rear section situated under a corresponding one of the plate (32). Consequently, the player can only strike the front section of the seesaw (33) to indirectly vibrating the plate (32). As a result, the degree of difficulty of operating the present invention is promoted. Base on the fair principle, the manager must arrange high value prize in the game machine for sorting the consumers according to their consuming ability and the players can select a suitable game machine due to their consuming ability.

Although the invention has been explained in relation to its preferred embodiment, it is to be understood that many other possible modifications and variations can be made without departing from the spirit and scope of the invention as hereinafter claimed.

What is claimed is:

1. A game machine comprising:

a frame including a panel formed on a front side thereof, wherein the upper portion of the panel is transparent for a user to easily operate the game machine, an opening defined in a lower portion of the panel and a guide apparatus mounted in a lower portion of the frame for guiding a falling prize to the opening such that the player can easily take the falling prize;

a control unit mounted on the panel of the frame;

a rack assembly disposed in the frame, the rack assembly divided into multiple rooms, each room having a plate pivotally mounted therein for support the prize, each plate having a front edge extending out from a front side of the rack assembly for being struck;

a moving unit disposed in the frame and electrically connected to the control unit; and a hammering device mounted onto the moving unit and electrically connected to the control unit, the hammering device including a shelf mounted on the moving unit, a drive device mounted on the shelf, a clutch mounted on the drive device, a sensor mounted on the shelf and a hammer connected to the clutch, the hammer situated within a sensing area of the sensor when the clutch can be driven by the drive device and in a connecting condition, an angle of elevation of the hammer relative to sea level being less than 90 degrees corresponding to a front side of the rack assembly when the clutch is in a connecting condition.

2. The game machine as claimed in claim 1, wherein the clutch includes a drive gear securely on the drive device and a driven gear rotatably mounted onto the shelf, the drive gear having a toothed section peripherally formed thereon such that the clutch is in a connecting condition when the driven gear is engaged to the toothed section of the drive gear.

3. The game machine as claimed in claim 2, wherein the hammer includes a shaft laterally mounted onto one side of the driven gear and a counterweight secured on a free end of the shaft for promoting the momentum of the hammer when falling.

4. The game machine as claimed in claim 3, wherein the moving unit includes an X-axis moving device and a Y-axis moving device mounted on the X-axis moving device, the shelf of the hammering device is mounted on the Y-axis moving device such that the moving route of the hammering device forms a complete plane.

5. The game machine as claimed in claim 2, wherein the moving unit includes an X-axis moving device and a Y-axis moving device mounted on the X-axis moving device, the shelf of the hammering device is mounted on the Y-axis moving device such that the moving route of the hammering device forms a complete plane.

6. The game machine as claimed in claim 1, wherein the moving unit includes an X-axis moving device and a Y-axis moving device mounted on the X-axis moving device, the shelf of the hammering device is mounted on the Y-axis moving device such that the moving route of the hammering device forms a complete plane.

7. A game machine comprising:

a frame including a panel formed on a front side thereof, wherein the upper portion of the panel is transparent for a user to easily operate the game machine, an opening defined in a lower portion of the panel and a guide apparatus mounted in a lower portion of the frame for guiding a falling prize to the opening such that the player can easily take the falling prize;

a control unit mounted on the panel of the frame;

a rack assembly disposed in the frame, the rack assembly divided into multiple rooms, each room having a plate pivotally mounted therein for support the prize, the rack assembly including multiple seesaws, wherein each seesaw is pivotally mounted into a front portion of a corresponding room, the seesaw divided into a front section provided for being struck and a rear section situated under a corresponding plate;

a moving unit disposed in the frame and electrically connected to the control unit; and a hammering device mounted onto the moving unit and electrically connected to the control unit, the hammering device including a shelf mounted on the moving unit, a drive device mounted on the shelf, a clutch mounted on the drive device, a sensor mounted on the shelf and a hammer connected to the clutch, the hammer situated within a sensing area of the sensor when the clutch can be driven by the drive device and in a connecting condition, an angle of elevation of the hammer relative to sea level being less than 90 degrees corresponding to a front side of the rack assembly when the clutch is in a connecting condition.

8. The game machine as claimed in claim 7, wherein the clutch includes a drive gear securely on the drive device and a driven gear rotatably mounted onto the shelf, the drive gear having a toothed section peripherally formed thereon such that the clutch is in a connecting condition when the driven gear is engaged to the toothed section of the drive gear.

9. The game machine as claimed in claim 8, wherein the hammer includes a shaft laterally mounted onto one side of the driven gear and a counterweight secured on a free end of the shaft for promoting the momentum of the hammer when falling.

10. The game machine as claimed in claim 9, wherein the moving unit includes an X-axis moving device and a Y-axis moving device mounted on the X-axis moving device, the shelf of the hammering device is mounted on the Y-axis moving device such that the moving route of the hammering device forms a complete plane.

11. The game machine as claimed in claim 8, wherein the moving unit includes an X-axis moving device and a Y-axis moving device mounted on the X-axis moving device, the shelf of the hammering device is mounted on the Y-axis moving device such that the moving route of the hammering device forms a complete plane.

12. The game machine as claimed in claim 7, wherein the moving unit includes an X-axis moving device and a Y-axis moving device mounted on the X-axis moving device, the shelf of the hammering device is mounted on the Y-axis moving device such that the moving route of the hammering device forms a complete plane.

* * * * *